US007150601B2

(12) United States Patent
Pietraszkiewicz et al.

(10) Patent No.: US 7,150,601 B2
(45) Date of Patent: Dec. 19, 2006

(54) TURBINE AIRFOIL COOLING PASSAGEWAY

(75) Inventors: Edward F. Pietraszkiewicz, Southington, CT (US); John C. Calderbank, Glastonbury, CT (US); Andrew D. Milliken, Middletown, CT (US); Jeffrey R. Levine, Wallingford, CT (US)

(73) Assignee: United Technologies Corporation, Hartford, CT (US)

( * ) Notice: Subject to any disclaimer, the term of this patent is extended or adjusted under 35 U.S.C. 154(b) by 70 days.

(21) Appl. No.: 11/021,152

(22) Filed: Dec. 23, 2004

(65) Prior Publication Data

US 2006/0140762 A1 Jun. 29, 2006

(51) Int. Cl.
*F01D 5/18* (2006.01)

(52) U.S. Cl. ..... 416/97 R; 415/115

(58) Field of Classification Search ..... 415/115; 416/97 R

See application file for complete search history.

(56) References Cited

U.S. PATENT DOCUMENTS 3,369,792 A * 2/1968 Kraimer et al. ..... 415/115
4,135,855 A * 1/1979 Peill ..... 416/90 R
4,930,980 A * 6/1990 North et al. ..... 415/115
5,511,309 A 4/1996 Beabout
5,741,117 A 4/1998 Clevenger et al.
5,827,043 A * 10/1998 Fukuda et al. ..... 415/115
5,931,638 A 8/1999 Krause et al.
6,471,479 B1 10/2002 Starkweather
6,508,620 B1 * 1/2003 Sreekanth et al. ..... 415/115
6,634,858 B1 10/2003 Roeloffs et al.
6,955,523 B1 * 10/2005 McClelland ..... 415/115
2001/0018024 A1 8/2001 Hyde et al.

FOREIGN PATENT DOCUMENTS

EP 1191189 A1 * 3/2002

* cited by examiner

*Primary Examiner*—Igor Kershteyn
(74) *Attorney, Agent, or Firm*—Bachman & LaPointe, P.C.

(57) ABSTRACT

An internally cooled gas turbine engine turbine vane has an outboard shroud and an airfoil extending from an outboard end at the shroud to an inboard end. A cooling passageway has an inlet in the shroud, a first turn at least partially within the airfoil, a first leg extending from the inlet inboard through the airfoil to the first turn, and a second leg extending from the first turn. A dividing wall is in the passageway and has an upstream end in an outboard half of a span of the airfoil and has a plurality of vents. The vane may be formed as a reengineering of a baseline configuration lacking the dividing wall.

24 Claims, 2 Drawing Sheets

TURBINE AIRFOIL COOLING PASSAGEWAY

BACKGROUND OF THE INVENTION

The invention relates to the cooling of turbomachine components. More particularly, the invention relates to internal cooling of gas turbine engine turbine blade and vane airfoils.

A well developed art exists regarding the cooling of gas turbine engine blades and vanes. During operation, especially those elements of the turbine section of the engine are subject to extreme heating. Accordingly, the airfoils of such elements typically include serpentine internal passageways. Exemplary passageways are shown in U.S. Pat. Nos. 5,511,309, 5,741,117, 5,931,638, 6,471,479, and 6,634,858 and U.S. patent application publication 2001/0018024A1.

SUMMARY OF THE INVENTION

One aspect of the invention involves an internally cooled gas turbine engine turbine vane having an outboard shroud and an airfoil extending from an outboard end at the shroud to an inboard end. A cooling passageway has an inlet in the shroud, a first turn at least partially within the airfoil, a first leg extending from the inlet inboard through the airfoil to the first turn, and a second leg extending from the first turn. A dividing wall is in the passageway and has an upstream end in an outboard half of a span of the airfoil and has a plurality of vents.

Another aspect of the invention involves a method for reengineering a configuration for an internally cooled turbomachine element from a baseline configuration to a reengineered configuration. The baseline configuration has an internal passageway through an airfoil. The passageway has first and second generally spanwise legs and a first turn therebetween. A wall is added to bifurcate the passageway into first and second portions. The wall extends within the passageway along a length from a wall first end to a wall second end. Otherwise a basic shape of the first cooling passageway is essentially maintained.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
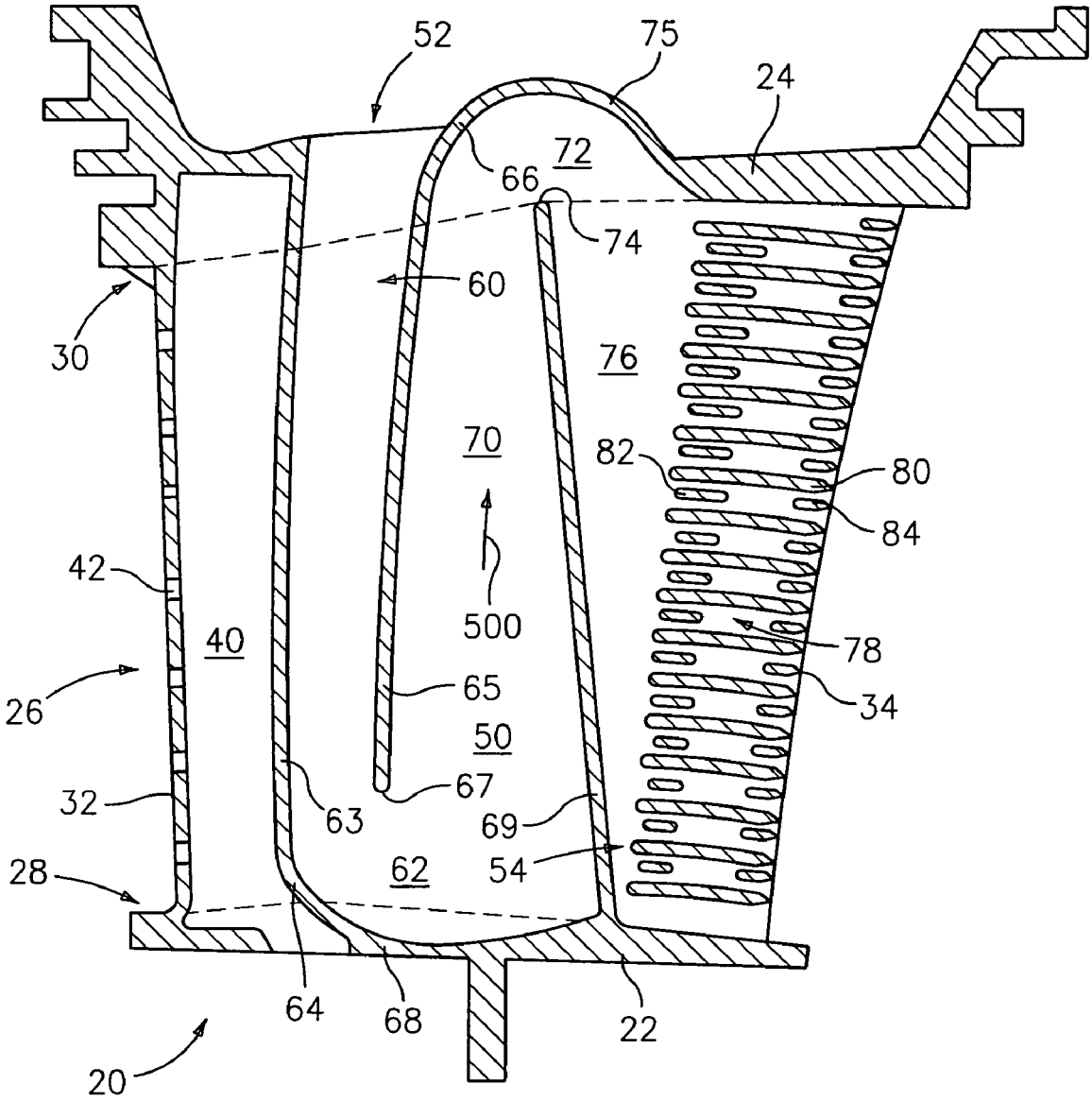
FIG. 1 (PRIOR ART)
FIG. 1 is a cut-away, partially-schematic, medial sectional view of a prior art airfoil.

FIG. 1 shows a turbine element 20. The element 20 represents a baseline element to which may be reengineered according to the present teachings. Other prior art or yet-developed elements may serve as alternative baselines. The exemplary element 20 is vane having an inboard platform 22 and an outboard shroud 24 and may be unitarily cast from a nickel- or cobalt-based superalloy and optionally coated.

The vane may be a turbine section vane of a gas turbine engine. An airfoil 26 extends from an inboard end 28 at the platform 22 to an outboard end 30 at the shroud 24 and has a leading edge 32 and a trailing edge 34 separating pressure and suction side surfaces.

In the exemplary element 20, one or more passageways of a cooling passageway network extend at least partially through the airfoil 26 for carrying one or more cooling airflows. In the exemplary airfoil, a leading passageway 40 extends just inboard of the leading edge 32 from an inlet at the platform 22 to the shroud 24 and discharges film cooling flows through leading edge cooling holes 42. Another passageway 50 extends more circuitously in a downstream direction 500 along a cooling flowpath from an inlet 52 in the shroud to an exemplary downstream passageway end 54 which may be closed or may communicate with a port in the platform.

An upstream first leg 60 of the passageway 50 extends from an upstream end at the inlet 52 to a downstream end at a first turn 62 of essentially 180°. As viewed in FIG. 1, the first leg 60 is bounded on a leading side by an adjacent surface of a first portion 63 of a first wall 64 separating the passageways 40 and 50. On a trailing side, the first leg 60 is bounded by a first portion 65 of a second wall 66. The passageway 50 is further bounded by adjacent portions of passageway pressure and suction side surfaces (not shown in FIG. 1). The exemplary second wall 66 extends downstream to an end 67 at the first turn 62. A second portion 68 of the first wall 64 extends along the periphery of the first turn 62 as a portion of the platform 22.

A second passageway leg 70 extends downstream from a first end at the center of the first turn 62 to a second end at a second turn 72. The second leg 70 is bounded along a trailing side by a continuation of the first surface of the wall 64 along a third portion 69 thereof. On the upstream side, the passageway 70 is bounded by an opposite second surface of the second wall 66 along the portion 65. The first wall 64 and its third portion 69 extend to an end 74 at the center of the second turn 72. A second portion 75 of the second wall 66 extends along the periphery of the second turn 72 as a portion of the shroud 24.

A third passageway leg 76 extends from a first end at the second turn 72 to a second end defined by the passageway end 54. The third leg 76 is bounded on a leading side by a second surface of the first wall third portion 69 opposite the first surface thereof and extending downstream along the path 500 from the wall end 74. Along a trailing side, the third leg 76 is open to an outlet slot 78 containing groups of exemplary features such as ribs 80, upstream posts 82, and downstream/outlet posts 84 at the trailing edge 34.

In operation, a cooling airflow passes downstream along the flowpath 500 from the inlet 52 through the first leg 60 in a generally radially inboard direction relative to the engine centerline (not shown). The flow is turned outboard at the first turn 62 and proceeds outboard through the second leg 70 to the second turn 72 where it is turned inboard to pass through the third leg 76. While passing through the third leg 76, progressive amounts of the airflow are bled into the outlet slot 78, passing between the ribs 80 and around the posts 82 and 84 to cool a trailing edge portion of the airfoil.

Figure 2:
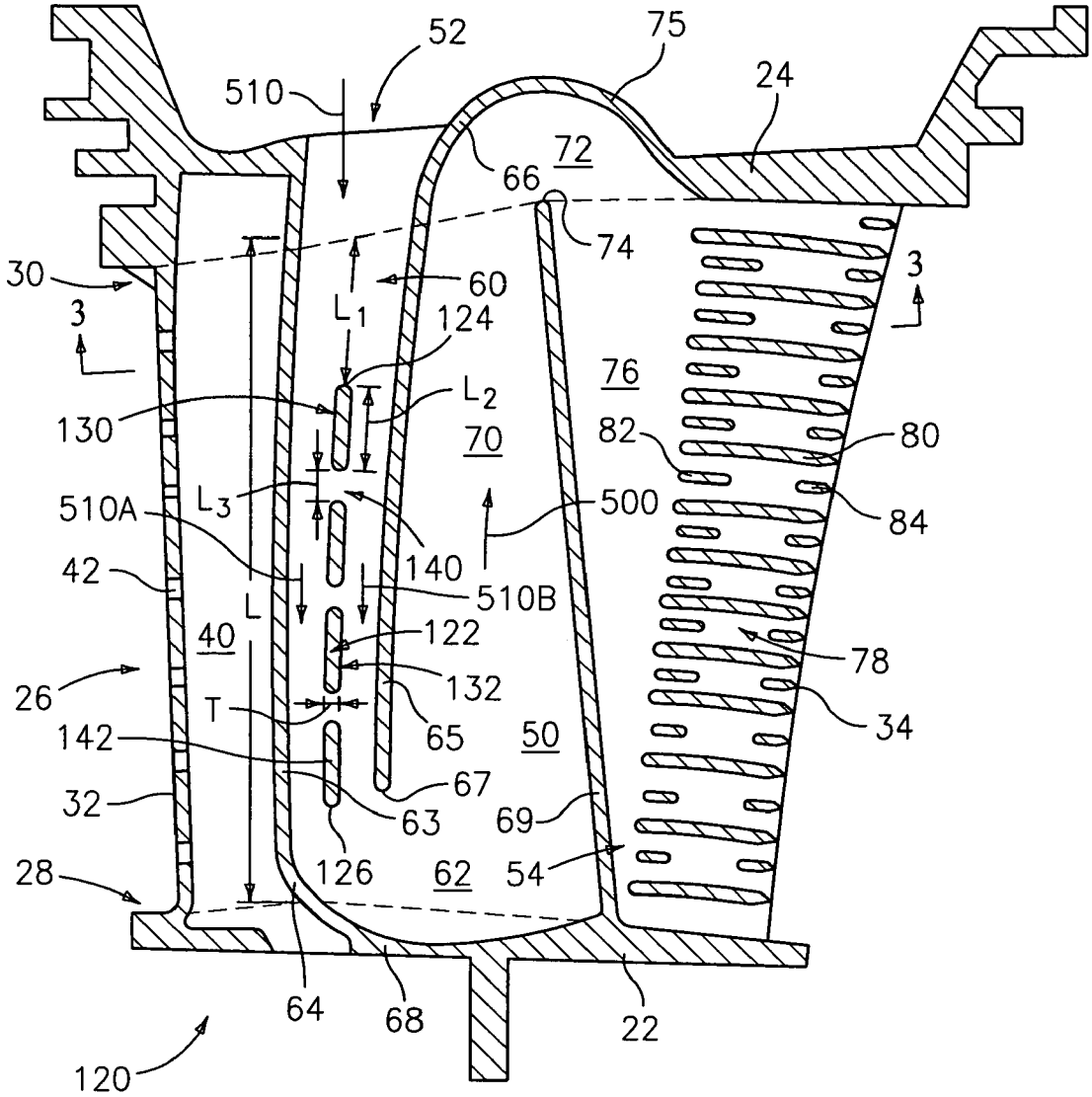
FIG. 2 is a cut-away, partially-schematic, medial sectional view of an of an airfoil according to principles of the invention.
Figure 3:
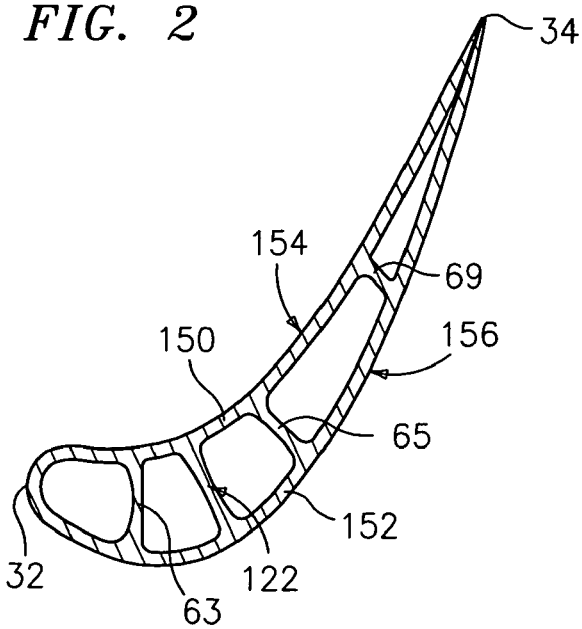
FIG. 3 is partial streamwise sectional view of the airfoil of FIG. 2, taken along line 3—3.

FIGS. 2 and 3 show a vane 120 which may be formed as a reengineered version of the vane 20 of FIG. 1. The exemplary reengineering preserves the general cooling passageway configuration (e.g., the shape and approximate positioning and dimensioning of the walls and other structural elements) but adds an exemplary single dividing wall 122 within at least a portion of the first leg 60 of the passageway 50. For ease of reference, elements analogous to those of the vane 20 are referenced with like reference numerals. The exemplary dividing wall 122 extends from a first/upstream end 124 to a second/downstream end 126 and has generally first and second surfaces 130 and 132. The dividing wall 122 locally splits or bifurcates the passageway 50 airflow 510 into first and second flow portions 510A and 510B.

The upstream end 124 of the dividing wall 122 is advantageously sufficiently downstream of the inlet 52 so that the flow 510 is fully developed before reaching the upstream end 124. In the exemplary airfoil, the upstream end 124 is in an upstream half of the first leg 60. The exemplary downstream end 126 is near or slightly within the first turn 62. Considerations regarding the location of downstream end 126 are discussed below.

The flow portions 510A and 510B fully rejoin at the downstream end 126. It is advantageous to provide a smooth rejoinder for maximizing flow. This may at least partially be achieved by providing intermediate communication between the flow portions 510A and 510B to balance their pressure so that rejoinder turbulence at the downstream end 126 is minimized. Communication may, for example be provided by apertures or interruptions in the wall 122. In the exemplary embodiment, gaps 140 divide the wall 122 into a plurality of segments 142.

The addition of the dividing wall 122 may have one or more of a number of potential benefits. FIG. 3 shows the wall 122 spanning between pressure and suction side walls 150 and 152 along respective pressure and suction side surfaces 154 and 156 of the airfoil. One direct effect is that the presence of the wall 122 may increase effective heat transfer from one or both the walls 150 along the first leg 60. In a first of several potential heat transfer mechanisms, the additional heat may be transferred through the dividing wall surfaces 130 and 132 to the flow portions 510A and 510B. A second mechanism may occur if the wall 122 locally reduces the flow cross-sectional area relative to the baseline vane lacking the wall. Such a reduction may cause a local increase in mach number (especially if compensatory reductions in flow restriction are made elsewhere along the passageway as is discussed below). The increased mach number produces an increased specific heat transfer from the walls 150 and 152.

An exemplary compensatory reduction in flow restriction is made downstream by reducing restriction in the outlet slot 78. This reduction in restriction may be achieved in one or more of many ways. For example, the numbers of features 80, 82, and 84 may be reduced, increasing their spacing and separation and reducing the effective blockage of the slot. The features 80, 82, and 84 may be thinned to increase their separation. Alternative features may replace the features 80, 82, and 84 to provide the reduction in restriction.

Another possible direct benefit is strengthening. The exemplary wall 122 structurally connects the walls 150 and 152. This reduces possible bulging, especially of the outwardly convex suction side wall 152, and helps maintain the desired aerodynamic shape.

Any increased heat transfer to further cool the airfoil will tend to reduce the tendency toward oxidation. It will also reduce the magnitude of thermal cycling. The strengthening may also reduce the strain involved in mechanical cycling. In one of many synergies, the reduced mechanical strain may further help avoid spalling of anti-oxidation coatings, thereby further reducing the chances of oxidation. The reduced thermal cycle magnitude and mechanical strain along with the reduced oxidation will reduce the tendency toward thermal-mechanical fatigue (TMF), thereby potentially increasing part life or permitting other changes to be made that would otherwise unacceptably degrade part life.

A number of considerations apply to the configuration of the wall 122. As noted above, the wall advantageously begins only after the flow 510 is essentially fully developed. However, the wall advantageously begins far enough upstream to provide desired benefits along the desired region of the airfoil. For example, the flow may not be fully developed in the proximal portion of the passageway 50 within the shroud 24. Thus, the wall 122 may begin at a distance $L_1$ into the airfoil. Exemplary $L_1$ values are 5–50% of the local airfoil span L, more narrowly, 10–30% (e.g., about one quarter). The wall 122 may continue over a majority of the span. (e.g., 50–75%). Although the wall may end at or near the turn 62, the wall may extend further (e.g., to form a turning vane extending mostly through the first turn 62 or even beyond into the second leg 70).

The exemplary wall is shown having a thickness T. Exemplary thickness is similar to thicknesses of the walls 64 and 66 and may be a small fraction of the passageway thickness (e.g., 5–20%, more narrowly, about 8–15%, or close to 10% to locally reduce the effective passageway/flowpath cross-sectional area by a similar amount). The wall segments 142 may each have a length $L_2$ which is substantially greater than T (e.g., at least 3T, more narrowly 4–10 times T). The apertures 140 have lengths $L_3$ which also may be much smaller than $L_2$ (e.g., less than 30%). Thus, along the wall 122, the apertures will account for a small percentage of total area (e.g., less than about 25%, more narrowly, 10–20%). The elongatedness of the exemplary dividing wall segments along the cooling passageway and their close proximity may have advantages relative to alternate structures. For example, it may be less lossy than a line of circular-sectioned posts.

An alternate and more extensive reengineering might involve an attempt to partially (e.g., but not fully) compensate for the dividing wall's reduction in cross-sectional area along the bifurcated flowpath. For example, one or both of the walls (e.g., 64 and 66) defining the flowpath may be shifted slightly relative to the baseline airfoil of FIG. 1. If providing the dividing wall with a desired strength would otherwise decrease the area by an exemplary 15%, but an 8% restriction would achieve the desired air velocity, the wall shift could make up the difference. For example, with a first portion 63 (FIG. 2) of the first wall 64 fixed relative to its FIG. 1 counterpart, the third portion 69 may be shifted somewhat toward the airfoil trailing edge.

Depending on part geometry, the possibility exists of adding multiple dividing walls for a given leg. However, a single wall is believed typically sufficient and effective. Typically, no other features spanning pressure and suction sidewalls would be added adjacent the dividing wall in the first leg. Non-spanning features (e.g., turbulators) on the pressure and suction side walls may more appropriately be added or preserved from the baseline.

One or more embodiments of the present invention have been described. Nevertheless, it will be understood that various modifications may be made without departing from the spirit and scope of the invention. For example, the principles may be applied to the reengineering of a variety of existing passageway configurations. Any such reengineering may be influenced by the existing configuration. Additionally, the principles may be applied to newly-engineered configurations. Accordingly, other embodiments are within the scope of the following claims.

What is claimed is:

1. An internally-cooled gas turbine engine turbine vane comprising:

an outboard shroud;

an airfoil extending from an outboard end at the shroud to an inboard end;

a cooling passageway having:

an inlet in the shroud;

a first turn at least partially within the airfoil;

a first leg extending from the inlet inboard through the airfoil to the first turn; and a second leg extending from the first turn and separated from the first leg by a wall; and a dividing wall in the passageway, dividing at least one of the first and second legs, and having:

an upstream end in an outboard half of a span of the airfoil; and a plurality of vents.

2. The vane of claim 1 wherein:

there are no additional features extending between airfoil pressure and suction side walls along the first leg.

3. The vane of claim 2 wherein:

the dividing wall has a length within the first leg of at least half the span of the airfoil.

4. The vane of claim 1 wherein:

the dividing wall essentially locally divides the first leg into first and second flowpath portions, each having a cross-sectional area at least 35% of a combined cross-sectional area.

5. The vane of claim 1 wherein:

the dividing wall extends to a second end outboard of the airfoil inboard end and not downstream of a middle of the first turn.

6. The vane of claim 1 wherein:

the vane has a platform at the inboard end of the airfoil; and the first turn is partially within the platform.

7. The vane of claim 1 wherein:

the first turn is in excess of 90°.

8. The vane of claim 1 wherein:

the cooling passageway extends to a trailing edge discharge slot.

9. The vane of claim 1 wherein the wall and the dividing wall are in a unitary casting.

10. An internally-cooled turbomachine element comprising:

an airfoil extending between inboard and outboard ends; and internal surface portions defining a cooling passageway at least partially within the airfoil, wherein:

the cooling passageway has a first turn from an upstream first leg to a downstream second leg, a wall separating the upstream leg from the downstream leg;

a dividing wall bifurcates a section of the cooling passageway into first and second portions and extends within the passageway along a length from a wall first end in the first leg to a wall second end, the wall first end being in an upstream half of a portion of the first leg within the airfoil, there being no additional features extending between airfoil pressure and suction side walls along the first leg; and the dividing wall has a plurality of apertures.

11. The element of claim 10 wherein:

the first and second portions each provide 35–65% of a cross-sectional area of the cooling passageway along said length of the dividing wall.

12. The element of claim 10 wherein:

the dividing wall second end is proximate an end of the first leg at the first turn.

13. The element of claim 10 wherein:

the passageway has a second turn from the second leg to a third leg;

the wall extends along a majority of an airfoil span.

14. The element of claim 10 wherein:

the passageway has a second turn from the second leg to a third leg;

the third leg is along a trailing edge discharge slot.

15. The element of claim 10 being a vane and having:

an inboard platform; and an outboard shroud.

16. The element of claim 10 wherein:

the dividing wall first end is located between 10% and 30% of a spanwise distance from the airfoil outboard end to the airfoil inboard end.

17. The element of claim 10 wherein the element consists essentially of a unitary casting.

18. A method for reengineering a configuration for an internally-cooled turbomachine element from a baseline configuration to a reengineered configuration wherein the baseline configuration has an internal passageway through an airfoil and having first and second generally spanwise legs and a first turn therebetween, the method comprising:

adding a wall to bifurcate the passageway into first and second portions, the wall extending within the passageway along a length from a wall first end to a wall second end; and otherwise essentially maintaining a basic shape of the first cooling passageway.

19. The method of claim 18 wherein:

the first turn is around an end of a second wall.

20. The method of claim 18 wherein:

the wall has a series of apertures.

21. The method of claim 18 wherein:

the wall extends within the first leg for at least 50% of a length of the first leg within the airfoil.

22. The method of claim 18 wherein;

no additional features are added along the first leg to span between pressure and suction side walls.

23. The method of claim 18 wherein:

the wall extends within the first leg.

24. The method of claim 18 wherein the adding comprises adding the wall to a casting.

* * * * *